United States Patent [19]

Golner et al.

[11] 4,119,251

[45] Oct. 10, 1978

[54] CONTAINER FOR DISPENSING FILM

[75] Inventors: Jerold Julius Golner, Lowell; William Joseph Miller, North Andover; Russell Brown Strout, Winchester, all of Mass.

[73] Assignee: Borden, Inc., Columbus, Ohio

[21] Appl. No.: 816,026

[22] Filed: Jul. 15, 1977

[51] Int. Cl.[2] ..... B26F 3/02

[52] U.S. Cl. ..... 225/20; 225/21; 225/47; 225/53

[58] Field of Search ..... 225/19–21, 225/53, 47

[56] References Cited

U.S. PATENT DOCUMENTS

| | | | |
|---|---|---|---|
| 1,630,495 | 5/1927 | Marcalus | 225/20 |
| 2,929,907 | 3/1960 | Collins | 225/20 X |
| 3,552,614 | 1/1971 | Wilson et al. | 225/20 |
| 3,565,307 | 2/1971 | Wiley et al. | 225/19 X |

FOREIGN PATENT DOCUMENTS

| | | | |
|---|---|---|---|
| 248,753 | 7/1912 | Fed. Rep. of Germany | 225/20 |

*Primary Examiner*—Frank T. Yost

*Attorney, Agent, or Firm*—George A. Kap; George P. Maskas; Daniel D. Mast

[57] ABSTRACT

This block-shaped container is characterized by a spring means which maintains cover of the container above serrated cutter in its inoperative condition thus preventing the hands of the user from accidentally coming in contact with the cutter.

4 Claims, 3 Drawing Figures

CONTAINER FOR DISPENSING FILM

This invention relates to a safe and reliable container for dispensing and cutting film material. More specifically, this invention relates to a container including a film dispenser box which contains a roll of film, preferably plastic film, wound on a core and a cutting element at the upper edge of the front panel which is protected during non-use by a cover extending above the cutting element by virtue of a spring means biasing the front edge of the cover upwards. In this manner, the sharp edges of the cutter element are shielded from hands and other parts of the user which could otherwise accidentally come in contact therewith. Some of the reported injuries involving conventional dispenser boxes were serious enough to require stitches.

The prior art reflects attempts made to reduce occurrence of such cuts caused by accidental contact with the cutting element secured to a film dispenser box. Although some of the prior art solutions may be acceptable, the invention disclosed herein provides a similar solution but in a different way. The prior art referred to herein is the Wilson U.S. Pat. No. 3,552,614 which relates to a film dispenser box equipped with a shield having a resilient upper flap extending above the cutting element and in this fashion preventing contact therewith.

The accompanying drawing illustrates a preferred embodiment of our container wherein.

Figure 1:
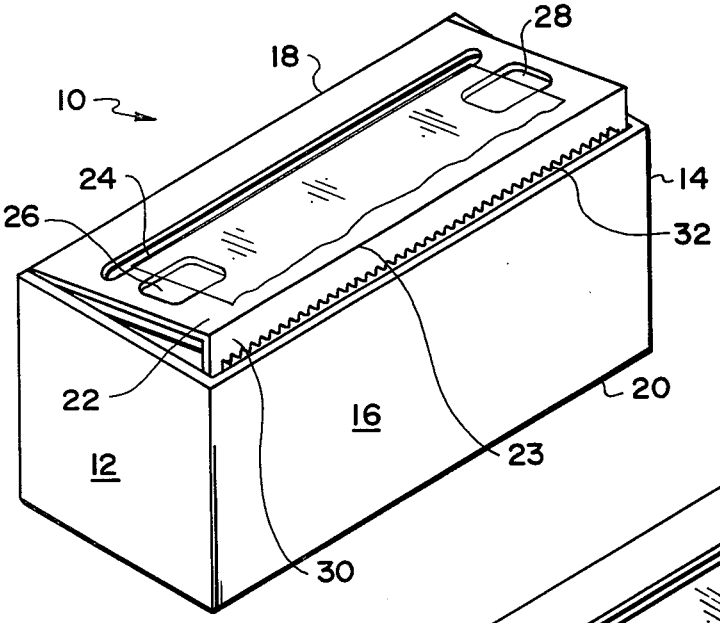
FIG. 1 shows the container in its inoperative condition with the front edge of the cover extending well above the cutting element to shield it from contact by hands or other parts of the user.

Referring to the drawings which illustrate our preferred embodiment, FIG. 1 depicts a dispenser box 10 which is of a generally rectangular construction having a pair of spaced vertical side panels 12, 14 with front panel 16 and rear panel 18 extending therebetween also in spaced relationship. Bottom panel 20 and cover panel 22 complete construction of the dispenser box. The panels are square or rectangular, being disposed in pairs in spaced and opposed relationship.

The cover panel 22 is hingedly secured to the rear panel 18 and includes a transversely disposed elongated dispensing slot 24 which extends almost the entire width of the cover panel parallel to and closely spaced from the edge formed by the cover and rear panel. A roll of film is disposed within the dispenser box and is delivered to the user through slot 24. As should be apparent, the length of the dispensing slot must be sufficient to accommodate the width of the film with some clearance on each side to allow free withdrawal of the film. Finger slots 26, 28 are provided in the cover panel at opposite ends of dispensing slot 24 and are disposed so that they extend beyond the outer extremities of the dispensing slot. The purpose of this particular arrangement is to allow fingers to grasp the film draped over the finger slots since the film usually clings to the box and is difficult to pick up. Since the finger slots extend beyond the dispensing slot at both ends thereof, the film covers only a portion of the slots leaving space for fingers to enter the slots and grasp the film at the side edges thereof. As is clearly illustrated in the drawings, finger slots are positioned ahead of the dispensing slot spaced some distance from the forward edge of 23 of cover panel 22.

Cover panel 22 is also provided with front flap 30 extending downwardly at about the right angle thereto tucked inside the box against and parallel to front panel 16. Flap 30 is connected to cover panel 22 through edge 23. Vertical extent of flap 30 is only a fraction of the height of the front panel 16 amounting to about one quarter thereof and being of the same width as the cover panel. Cutter element 32 is secured to the upper edge of front panel 16 and has serrations which project above the upper edge of the front panel. The cutter element extends the distance between side panels 12, 14 but it need to be only wide enough to accommodate film of a particular width.

Figure 3:
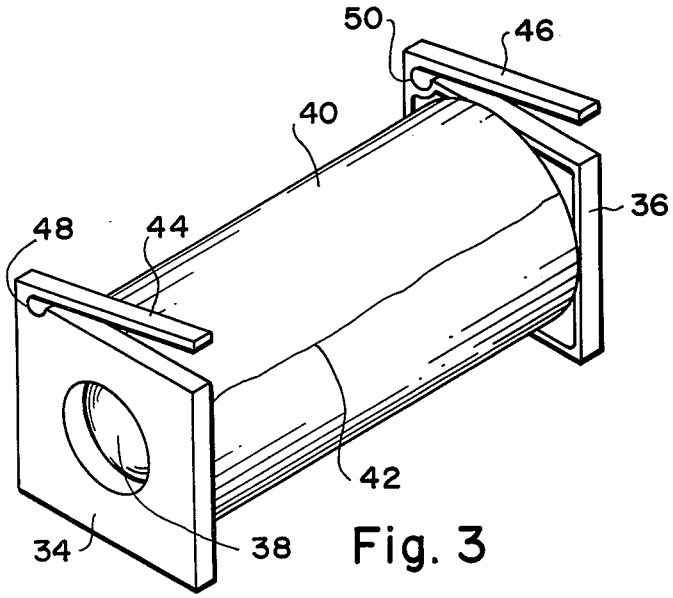
FIG. 3 is the preferred embodiment of the end supports for the roll of film, the supports being provided with spring means which bias the cover upwards.

The novel feature of this invention is shown in FIG. 3 in its preferred embodiment. End supports or plugs 34 and 36, which correspond in configuration and size to the side panels 12 and 14, are spaced apart by core 38 which is secured to the plugs in any suitable manner. Core 38 supports roll of film 40 which can be easily unwound from the roll by pulling on the free end 42. The essence of the invention resides in the provision of resilient biasing means to maintain cover panel in a raised position above the cutter element 32. The resilient biasing means can take many forms and can be associated with the box itself or the support means for the roll of film. One specific embodiment includes spring elements 44, 46 being either integral with or separate from end supports 34, 36. In FIG. 3, the spring elements are joined to the end supports through loops 48, 50 which bias the spring elements upward. As shown in FIG. 3, the spring elements have width and length dimensions corresponding to that of the end supports, although this is not necessary since the same function can be provided by elements of almost any shape or form having a springing action.

The roll assembly shown in FIG. 3 is assembled by mounting the roll of film on core 38, in a known manner. The roll assembly is then placed into the dispenser box with the spring elements supporting the cover panel at the sides in a raised position. Since end supports 34, 36 are about the same size and shape as the side panels 12, 14 of the dispenser box, the spring elements project considerably above the upper edges of the side panels and maintain edge 23 of cover panel well above cutter element 32.

Figure 2:
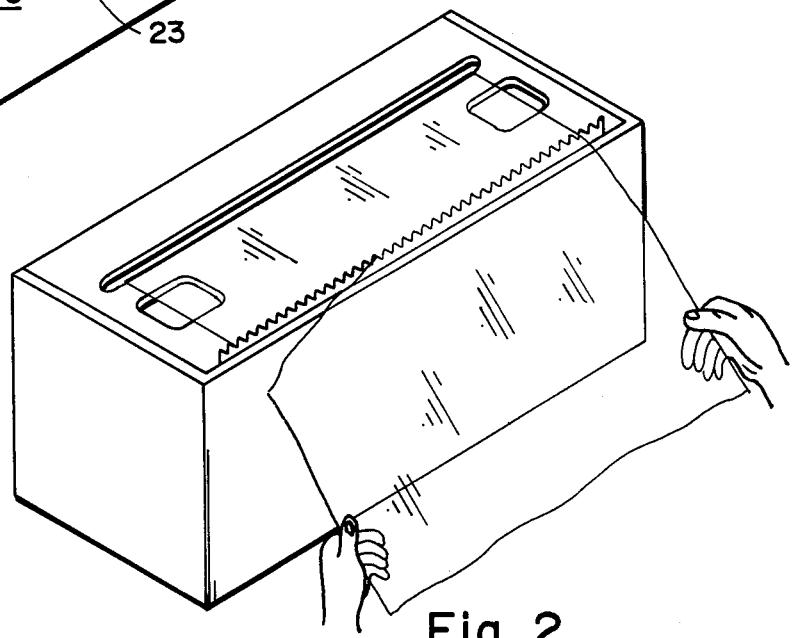
FIG. 2 shows the same box as that of FIG. 1 except in its operative condition wherein a portion of the film is being severed with tension applied to the film thus forcing the cover downwardly to permit the film to contact the cutter element.

After disposing the roll assembly in the dispenser box, free end 42 of film 40 is threaded through dispensing slot 24 over finger slots 24, 26 and over cutter element 32. To affect severing of the film, enough of it is unrolled from the roll and it is then grasped either at the end or opposite edges thereof and lowered against the cutter element. The spring elements are resilient enough to yield to the pressure exerted by the film when it is brought against the cutter element, as illustrated in FIG. 2. There is sufficient friction between cooperating parts of the core and the end supports during unwinding of the film to press the spring elements down when film is forced against the cover panel. If additional friction is necessary, suitable restraining means can be supplied, as is known in the art. After the film has been severed, the spring elements spring back to elevate the cover panel above the cutter element and thus shield it from contact by hands of the user.

We claim:

1. A container for dispensing film material on a roll comprising a container body having rear, bottom and two side panels forming an interior enclosure with a cover therefore associated with said container; a dispensing slot provided in said cover extending substantially the entire length thereof; a cutter element secured to the upper edge of said front panel extending from one end to the other and projecting thereabove; means for resiliently urging said cover above said cutter element; a pair of end supports for roll of the film material disposed in said enclosure on said bottom panel and against said side panels, said resilient means being associated with at least one of said end supports.

2. Container of claim 1 for dispensing plastic film wherein said resilient means is a spring element secured to at least one of said end supports, said spring element supporting front edge of said cover above said cutter element in its the inoperative condition and having sufficient resiliency to be deflected downward when the film is pulled thereover for severing.

3. Container of claim 2 including a flap secured to said cover extending at about right angle thereto and being disposed inwardly of and against said front panel; and a pair of finger slots disposed at both ends and ahead of said dispensing slot extending beyond the dispensing slot at both ends thereof to facilitate grasping of the film with fingers.

4. Container of claim 3 wherein said resilient means are secured to the upper portion of said end supports and said cutter element has serrations at the upper edge thereof to facilitate severing of the film.

* * * * *